United States Patent [19]

Marchese

[11] 4,150,828

[45] Apr. 24, 1979

[54] CHECKERBOARD GAME

[76] Inventor: Anthony Marchese, c/o S. Effron, 279 Springtown Rd., New Paltz, N.Y. 12561

[21] Appl. No.: 820,878

[22] Filed: Aug. 1, 1977

[51] Int. Cl.[2] ..... A63F 3/02

[52] U.S. Cl. ..... 273/260; 273/282; 273/287; 273/288

[58] Field of Search ..... 273/260, 261, 282, 287, 273/288; D34/5 CH, 5 GP; 206/468

[56] References Cited

U.S. PATENT DOCUMENTS

| | | | |
|---|---|---|---|
| D. 210,960 | 5/1968 | Gabel | D34/5 CH |
| D. 210,962 | 5/1968 | Gabel | D34/5 CH |
| D. 210,963 | 5/1968 | Gabel | D34/5 CH |
| D. 210,964 | 5/1968 | Gabel | D34/5 CH |
| 498,702 | 5/1893 | Watson | D34/5 CH UX |
| 663,249 | 12/1900 | Whitman | 273/282 |
| 1,529,598 | 3/1925 | Lee | 273/245 |
| 2,739,701 | 3/1956 | Sarratt et al. | 206/468 X |
| 3,761,093 | 9/1973 | Migliore | 273/282 X |
| 4,026,557 | 5/1977 | LeBrun et al. | 273/243 |

OTHER PUBLICATIONS

Playthings, Dec. 1960, p. 52.

*Primary Examiner*—Anton O. Oechsle
*Attorney, Agent, or Firm*—Richard L. Miller

[57] ABSTRACT

A game including a game box, the bottom of which forms the playing field which is of checkerboard configuration having five rows and five columns of checkerboard squares. Two similar sets of playing pieces are provided with each set being distinguishingly identified from the other. Each set includes five playing pieces; two cubes, two tetrahedrons and one sphere with a flattened bottom to permit it to be positioned on the playing field. Storage sections are provided in the box adjacent to one opposing pair of ends of the box. The storage sections include a top wall having geometrically configured openings which correspond to the shapes of the playing pieces so that each opening can receive its respective playing piece. The game combines features of both chess and checkers.

6 Claims, 4 Drawing Figures

CHECKERBOARD GAME

BACKGROUND OF THE INVENTION

This invention relates to a game and more specifically to a checkerboard game combining the features of both chess and checkers.

Numerous games are available utilizing a checkerboard playing field. The most famous, and popular, are the games of checkers and chess. Both of these games are well known and have been well established among all peoples. The game of checkers, however, is often too simple for many people who would prefer a more challenging game. Checkers utilize only a single type of playing piece having only a single capability of movement on the playing field. Many of these individuals who seek a more challenging and intellectual game will prefer the popular and well known game of chess. In this game, there are many different types of pieces each with its own unique ability of movement.

However, there are many individuals who find the game of checkers insufficient to challenge their intellectual capabilities, but on the other hand find the game of chess to be too demanding, time consuming, and too intricate and involved to provide a regular enjoyable game.

The present invention provides a unique balance between the game of checkers and the game of chess. On the one hand it is not quite chess and yet it is not quite checkers. Nevertheless, it is more intricate and involved than the relatively simple rules of checkers but not as difficult and complex as the game of chess. Furthermore, it requires a smaller playing field than chess or checkers and accordingly can be made into a more transportable and easily compact type of game.

SUMMARY OF THE INVENTION

Accordingly, it is an object of the present invention to provide a new and improved game utililizing a checkerboard type of playing field.

A further object of the present invention is to provide a game which combines the benefits and features of chess and checkers in a single game.

Another object of the present invention is to provide a game which includes a gameboard and playing pieces and wherein the entire game is maintained within a gamebox.

A further object of the present invention is to provide a game having a gamebox with the gameboard forming the base of the gamebox and one pair of opposing sidewalls serving as the storage compartments for the playing pieces.

A further object of the present invention is to provide a game having a gameboard and utilizing geometrically configured playing pieces for manipulation on the playing field.

Briefly, the invention provides for a game comprising a gameboard which has a checkerboard playing field thereon.

Two similar sets of playing pieces are provided with the playing pieces of each set being distinguishingly identified from the other. Each of the sets includes at least three distinctly configured playing pieces, each playing piece being of a geometric configuration.

In an embodiment of the invention, each set of playing pieces comprises two cubes, two tetrahedrons, and a single sphere having a flattened bottom. The gameboard is provided as the base of a gamebox which has sidewalls and a cover. A pair of storage compartments are positioned adjacent one opposing pair of sidewalls. The top of the storage compartment includes geometrically configured openings corresponding to the geometric shapes of the playing pieces so that each opening can accommodate and receive one of the playing pieces.

The aforementioned objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWINGS

In the drawing.

In the various figures of the drawing, like reference characters designate like parts.

DESCRIPTION OF THE PREFERRED EMBODIMENT

The game of the present invention includes a gamebox shown generally at 10 having side walls 12, 14, 16, and 18. On the base 20 of the gamebox is placed a gameboard 22 having a checkerboard playing field which includes playing squares formed in rows and columns. On the playing field there are shown five rows and five columns of the playing squares with adjacent squares being alternately identifiable from each other. By way of example, the squares can alternate in color having one square black and its adjacent squares red to form the checkerboard pattern.

Figure 3:
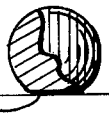
FIG. 3 is a cross sectional view taken on line 3—3 of FIG. 1 and showing the shape of the spherical playing piece.

The game further comprises playing pieces shown generally at 24. The playing pieces are each formed of geometric configuration. A first set of playing pieces includes two cubes 26; two tetrahedrons 28, and a sphere 30. As will be noted with respect to FIG. 3, the bottom 32 of the sphere is flattened so that the sphere can stand in one position on the playing field.

A second set of similar playing pieces 34 is also provided. Two of the playing pieces are shown as being out of the gamebox, while three of the playing pieces are shown in their storage position within the gamebox. The two sets, while being of identical shaped pieces, are distinguishingly identifiable from each other as having each set being of a different color. Adjacent opposing walls 12, 14, of the gamebox are provided storage areas 36, 38. The storage areas each include a top wall 40 which continues into a downwardly extending portion 42 which can connect to the sidewall. The opposite end of the top wall 40 includes a downwardly extending front wall portion 44 which continues to be bent under and connect to the bottom wall at section 46. This forms a hollow compartment which can receive the playing pieces.

The top wall 40 of the storage compartment include geometrically shaped openings which can receive respectively correspondingly shaped playing pieces. Specifically, there are provided two square openings 48 which can receive the cubed pieces 26; two triangular openings 50 which can receive the tetrahedron pieces 28 and a circular opening 52 which can receive the sphere 30. The top wall 40 is formed so that its end inwardly of the box is at a lower position than the outermost edge. Furthermore, the height of the storage compartments 36, 38 are made less than the height of the playing pieces. In this manner, although a playing piece can be placed into its correspondingly shaped opening in the storage compartment, it will not fall into the storage compartment but will stick up out of the storage compartment. Furthermore, because of the downwardly shaped top wall of the storage compartment, it will be easy to grasp the playing piece from its respective storage opening and pull it out of its storage position to place it on the playing field.

Figure 1:
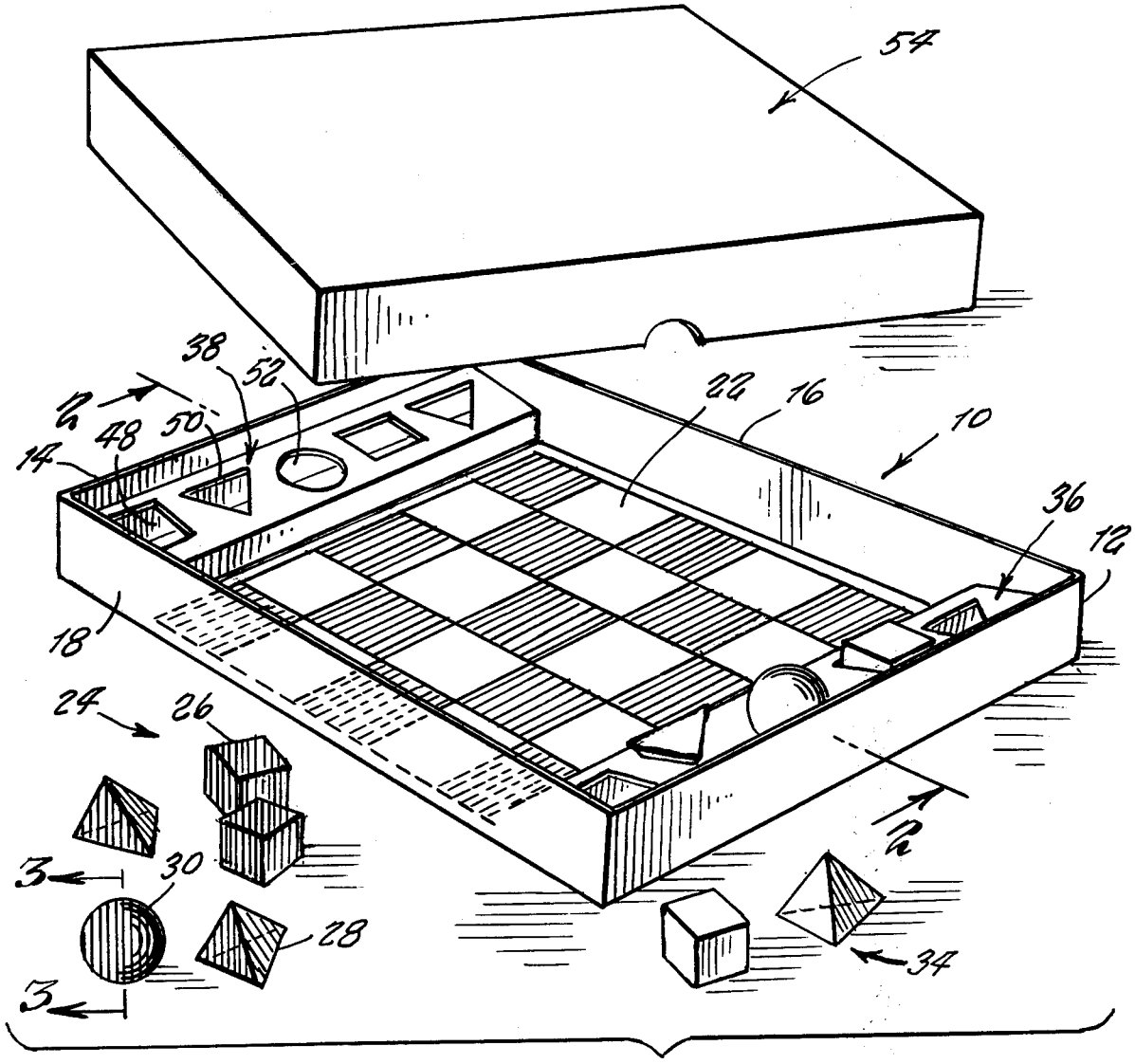
FIG. 1 is a perspective view of the game of the present invention.
Figure 2:
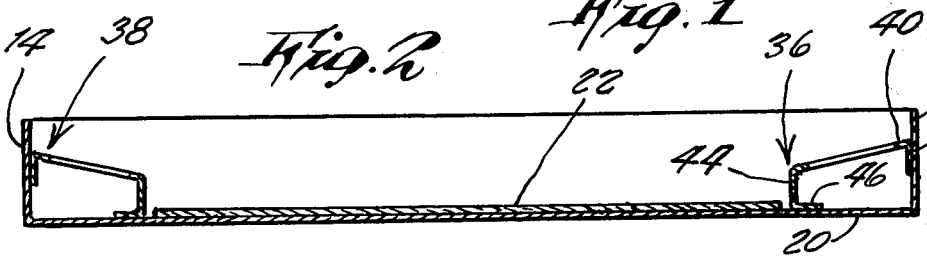
FIG. 2 is a cross sectional view taken on line 2—2 of FIG. 1 and showing the gamebox with the storage compartment and gameboard.

In addition to the gamebox there is provided a cover, shown generally at 54, which can be placed over the gamebox 10. Accordingly, in its stored postion, each of the playing pieces is fitted within its correspondingly shaped opening, as shown by the three pieces of the set 34 at the lower end of the gamebox in FIG. 1. The remaining playing pieces would similarly be placed in their corresponding openings. The cover can then be placed over the gamebox and the game stored.

When playing the game, the cover is removed and the playing pieces taken out of their storage locations and placed at their initial positions at opposing edges of the board.

Figure 4:
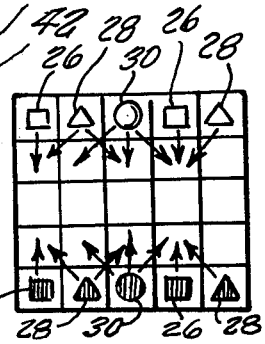
FIG. 4 is a schematic diagram of the playing pieces in their proper position on the gameboard at the start of the game and indicating by arrows the possible playing movements of the different playing pieces.

For an understanding of the game, reference will be had to FIG. 4. It will be remembered that in the game of checkers, there is only a single type of playing piece which only has a single capability of movement, until it becomes a king. In the game of chess on the other hand, there are many playing pieces each with a complicated set of moving capabilities. The present game combines the best features of the chess and checker games.

It will be noted that there are five rows and columns of playing pieces and correspondingly there are five playing pieces in each set. The playing pieces are positioned on the gameboard with the single sphere of each set placed at the middle position along a single row at opposing ends. The other playing pieces alternate with each other. As shown in FIG. 4, the cubes are placed at the outermost position on the left of the board followed by the tetrahedrons 28, followed by the spheres 30 placed in the center. Thereafter, again there is provided a cube 26 and finally a tetrahedron 28. It will therefore be appreciated that the initial setup of the playing pieces is not similar to chess where a symmetric configuration is provided for the playing pieces but rather an alternating configuration is provided.

For convenience, the playing pieces will be referred to as cubes, pyramids and globe. As shown in FIG. 4, the cubes can move vertically or horizontally one square at a time. The pyramids can move diagonally on the playing board one square at a time. The globe can move one square at a time in any direction.

The game begins with the playing pieces positioned as shown in FIG. 4. One side moves first, typically the white team. The first player can make any one of eight opening moves, as shown by the eight arrows in FIG. 4. Then, the other player moves, typically the red team. He too can make one of eight opening moves. Turns then alternate between the two players. The globe is the only piece which can be removed from the board. The object of the game being to attack and remove the opponent's globe.

The globe is considered under attack when the opponent, on his next move, can remove the globe with any one or more of his own playing pieces.

When the globe does come under attack the player whose globe is under attack must move his globe to a safe square, if possible. A safe square is considered any square where the globe is not threatened by the opponent's playing pieces on the next move.

The cubes and pyramids can only move to block an opponent's playing piece by commanding the square that it occupies itself. It can also serve to attack the opponent's globe.

In order to prevent stalling within the game, it is not permitted to move any piece back and forth between the same two squares for more than three consecutive moves. It is not permitted to surrounder your globe with your other pieces. Also, it is not permitted to move the globe within one square of the opponent's globe thereby allowing him to remove your globe from the board with his globe on the next move and thereby ending the game.

It is therefore apparent that the present game provides a simple fast moving game of skill and strategy. It is not quite as easy as checkers, nor as complicated as chess. It is quickly learned and provides enjoyment each and every time it is played.

Although a total of five playing pieces has been provided in each set and a total of five rows and five columns provided on the checkerboard, it will be appreciated that the game can be expanded by providing more playing pieces and more squares. For example, two additional rows and columns could be provided and each set of playing pieces would include two more playing pieces of identical geometric configuration, for example, a solid cylinder. In setting up the initial positions, these playing pieces would provide alternating positioning with the playing pieces described, and would be positioned on either side of the globe which would still be in the center.

It will therefore be appreciated that although additional playing pieces could be added, there will always be an odd number of rows and columns in the playing field since the globe always occupies the middle position and the remaining pieces are placed on either side thereof.

There has been disclosed heretofore the best embodiment of the invention presently contemplated. However, it is to be understood that various changes and modifications may be made thereto without departing from the spirit of the invention.

I claim:

1. A game comprising a square gameboard having a uniform checkerboard playing field throughout, and including an odd number of rows and columns each of which has the same number of playing squares as the other, and two similar sets of playing pieces, each set of playing pieces comprising a total number of pieces equal to said number of rows and including a single playing piece of geometric configuration, and pairs of additional playing pieces to equal said total number of pieces, each pair being of a different geometric configuration from the other pairs and from said single playing piece, the playing pieces of one set being distinguishingly identifiable from the playing pieces of the other set, and further comprising a gamebox for storing the playing pieces, said gameboard forming at least part of the base of said gamebox, said gamebox comprising four sidewalls extending upwardly from the base forming a substantially rectangular gamebox, and a cover positionable over the gamebox, and storage compartments positioned adjacent one pair of opposing sidewalls of said gamebox, said gameboard occupying the space between said storage compartments and the remaining pair of sidewalls, whereby a storage compartment is respectively positioned adjacent opposing ends of said gameboard, each of said storage compartments further comprising a top wall raised above said gameboard, geometrically configured openings formed in said top wall along a single row for respectively receiving therein said playing pieces, each opening respectively positioned adjacent a playing square, the geometrically configured openings respectively corresponding to the geometric configuration of the playing pieces and positioned along said single row in accordance with the initial positioning of the various playing pieces on the gameboard for playing the game.

2. A game as in claim 1, and wherein each set of playing pieces comprises two pieces of a first geometric configuration, two pieces of a second geometric configuration; and one piece of a third geometric configuration.

3. A game as in claim 2 and wherein said first geometric configuration is a cube, said second geometric configuration is a tetrahedron and said third geometric configuration is a sphere with a flattened bottom.

4. A game as in claim 3 and wherein said tetrahedron is of isosceles shape.

5. A game as in claim 2 and wherein said checkerboard playing field consists of five rows and five columns of playing squares, adjacent playing squares being alternatingly identifiable from each other.

6. A game as in claim 1 and wherein the height of said storage compartment is less than the height of the playing pieces and wherein said top wall of said storage compartment slopes downwardly from the sidewalls of the box toward the center of the box to thereby permit easy access to the playing pieces stored in the respective geometrically configured openings.

* * * * *